United States Patent [19]

Diener

[11] 4,119,293

[45] Oct. 10, 1978

[54] SUPPORT AND INSTALLATION JACK, HOLE FORMING DEVICES AND SETTING TOOL THEREFOR

[76] Inventor: Erhard Armin Diener, 643 Saskatchewan Crescent E., Saskatoon, Canada

[21] Appl. No.: 795,105

[22] Filed: May 9, 1977

[51] Int. Cl.[2] ..... B28B 7/30

[52] U.S. Cl. ..... 249/177; 29/267; 249/180; 249/184; 249/210; 267/71; 267/169

[58] Field of Search ..... 249/178, 180, 184, 186, 249/177, 157; 29/267; 267/69–71, 169; 254/51

[56] References Cited

U.S. PATENT DOCUMENTS

| | | | |
|---|---|---|---|
| 2,070,563 | 2/1937 | Cusack | 267/169 |
| 3,798,738 | 3/1974 | Purtell | 29/267 |
| 3,921,953 | 11/1975 | Diener | 249/177 |

*Primary Examiner*—Francis S. Husar
*Assistant Examiner*—John McQuade
*Attorney, Agent, or Firm*—Stanley G. Ade

[57] ABSTRACT

Hole forming devices have to be engaged between forms prior to pouring concrete. They are adapted to expand when in position to engage the inner faces of the forms thus holding them in position. The jack is a telescopic rod or tube having a heavy expansion spring surrounding same and normally urging the two portions of the hole forming device outwardly, but being held in the compressed or "set" position by means of a pin engaging through the two portions of the telescopic rod or tube. In one embodiment, when the pin is pulled, the sharpened ends of the rod or tube move away from one another, pierce the end caps of the forming device and engage the faces of the forms and at the same time move the end portions of the forming device outwardly into contact with the inner faces of the forms. In another embodiment, the ends of the rod or tube move outwardly and engage end pieces which in turn move outwardly and urge cylindrical saw-tooth end caps into contact with the inner faces of the walls of the form.

12 Claims, 9 Drawing Figures

SUPPORT AND INSTALLATION JACK, HOLE FORMING DEVICES AND SETTING TOOL THEREFOR

BACKGROUND OF THE INVENTION

This invention relates to new and useful improvements in support and installation jacks for hole forming devices which may be used in conjunction with hole forming devices. Furthermore, a setting tool is provided to facilitate the engagement of the hole forming devices between opposing forms prior to pouring concrete between said forms.

Conventionally, hole forming devices are held in the compressed position prior to insertion between the wall forms and they are then released by cutting straps or strings so that internal spring mechanisms move the end pieces outwardly and engage same with the inner faces of the opposing forms. Under normal circumstances, this may be satisfactory, but there is always the tendency of the concrete being poured, to displace the hole forming device and it is not practical to supply such devices with heavy enough springs to ensure adequate engagement with the inner faces of the side walls of the forms.

Furthermore, it is somewhat difficult to install such devices not only when they are relatively close to the upper end of the forms, but particularly so when they are some distance down from the upper end and adjacent the base of the forms.

SUMMARY OF THE INVENTION

This invention overcomes these disadvantages by providing a support and installation jack which is incorporated within the hole forming device during the construction thereof. This jack contains a heavy duty expansion spring which is normally held in the "set" position until released whereupon members are urged outwardly with considerable force and pressure to hold the hole forming device in the desired position.

Alternatively, the jacks may be separately between adjacent forms above or near the hole forming device to act as shields or guards during the pouring and vibration of concrete between the forms.

Also, a setting tool is provided which facilitates the placement of the hole forming device and allows easy release of the spring loaded jack when the device is in the desired position.

One aspect of the invention comprises a support and installation jack for hole forming devices installed between forms prior to pouring concrete therebetween, comprising in combination a telescoping element, a compression spring surrounding said element, means adjacent each end of said element between which said spring reacts, said spring normally urging said telescopic elements towards the released position, and means co-operating with said telescopic element to releasedly hold said element in the "set" position with said compression spring in the compressed condition.

Another aspect of the invention, in conjunction with the foregoing, is to provide such a jack in combination with a hole forming device, said jack being situated axially within said device, said hole forming device including a casing, a pair of end caps, one on each end of said casing and a pair of body portions slidable within said casing, means co-operating between said jack and said body portions for urging said body portions outwardly against said end caps when said means co-operating with said telescopic element, is released, said means co-operating between said jack and said body portions comprising anchoring means on the inner opposed faces of said body portions, and loop means extending between said anchoring means and the end of said element whereby when said element is released, the outward movement of the ends thereof moves said loop means and hence body portions outwardly away from one another and against said end caps.

Another advantage of the invention is the fact that a setting tool may be provided which may be actuated manually with the hole forming device detachably secured thereto or, may be operated remotely, readily and easily.

Still another object of the invention is to provide a device of the character herewithin described which is simple in construction, economical in manufacture and otherwise well suited to the purpose for which it is designed.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:

DESCRIPTION OF THE FIGURES

In the drawings like characters of reference indicate corresponding parts in the different figures.

DETAILED DESCRIPTION

Figure 1:
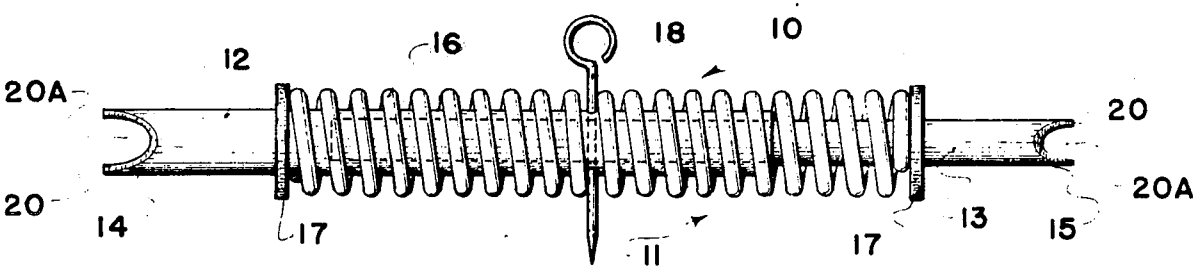
FIG. 1 is a side elevation of the support and installation jack shown in the "set" position.
Figure 2:
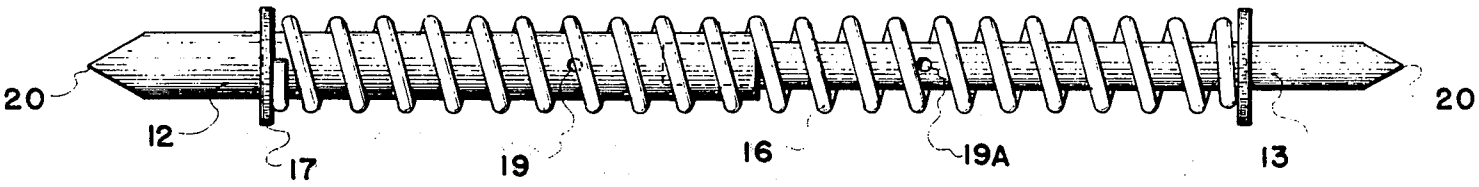
FIG. 2 is a view similar to FIG. 1, with the pin removed and the jack being shown in the released or expanded position.
Figure 3:
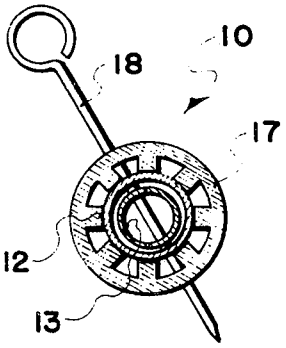
FIG. 3 is an end view of FIG. 1.

Proceeding therefore to describe the invention in detail, reference should first be made to FIGS. 1, 2 and 3, in which a support and installation jack is shown generally designated 10.

It consists of a telescopic element collectively designated 11 which, in this embodiment, comprises two members 12 and 13. Member 12, in this embodiment, is tubular and member 13 slidably engages therewithin.

Means are provided adjacent each distal end 14 and 15 of the members 12 and 13 respectively, between which a heavy duty expansion spring 16 engages. In this embodiment, said means takes the form of a pair of friction washers 17 surrounding the respective members 12 and 13 adjacent the ends thereof with a heavy duty coil spring 16 surrounding the members and engaging between the washers 17 as clearly shown.

When in the "set" position, the two members 12 and 13 are urged together thus compressing spring 16 and a release pin 18 is releasably engaged through mating apertures 19 and 19A in the members 12 and 13 thus preventing the spring 16 from urging the two members apart from one another.

However, when the pin is withdrawn as will hereinafter be described, the spring 16 expands thus forcing the two members 12 and 13, away from one another as shown in FIG. 2.

The distal ends 14 and 15 are end sharpened as indicated by reference character 20, the purpose of which will hereinafter become apparent.

Figure 4:
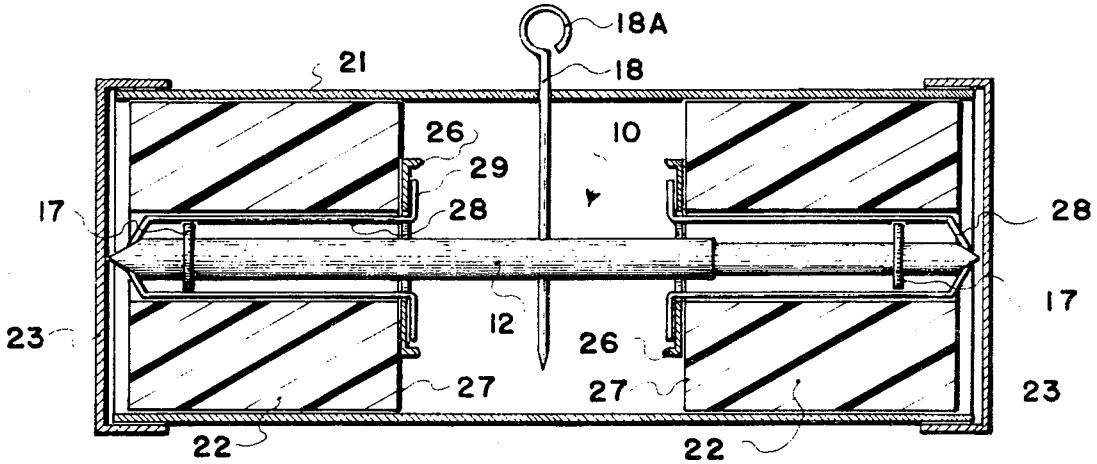
FIG. 4 is a cross sectional view of one embodiment of a hole forming device with the jack incorporated therein and shown in the "set" position.

It is desirable but not essential that these jacks be incorporated within hole forming devices, two types of which are illustrated in FIGS. 4/5 and 6/7.

Figure 5:
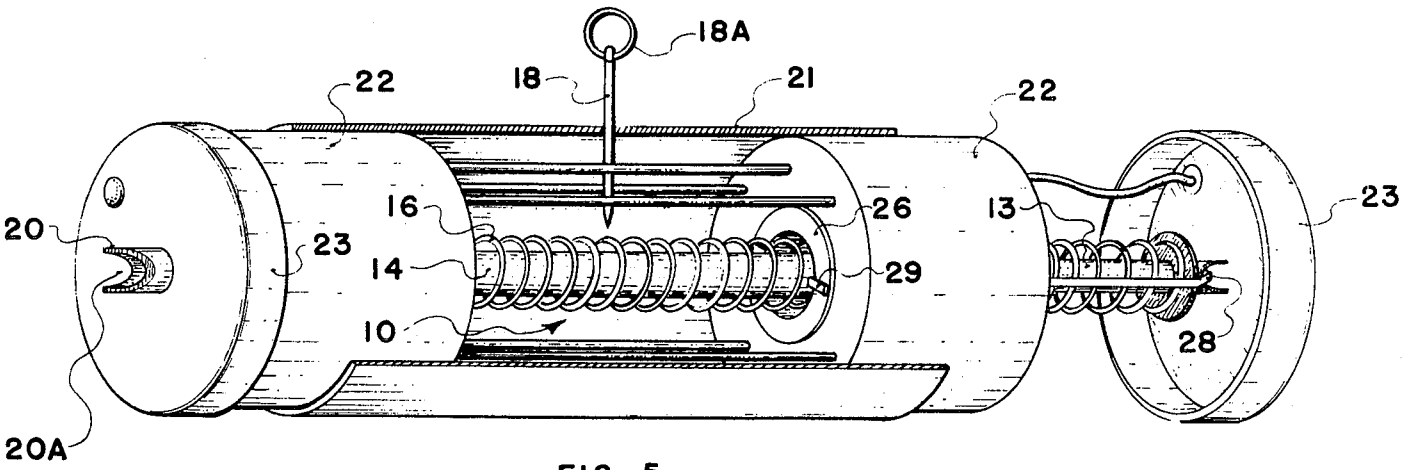
FIG. 5 is an isometric view of FIG. 4, broken away in part to show the interior thereof and showing the jack in the released position.

Dealing first with the type shown in FIGS. 4 and 5, a casing 21 is illustrated which, in this embodiment, is cylindrical although other shapes can be used.

A pair of body portions 22 slidably engage within the casing and end caps 23 engage over the ends of the casing as clearly shown. In this embodiment, the body portions are formed from a rigid foam material such as "styrofoam", although other materials can be utilized.

The jack 10 is axially engaged within this hole forming device extending through the body portions 22 and terminating, when in the "set" position, adjacent the inner faces of the end caps 23 as clearly shown.

The pin 18 extends through the casing with a finger engaging loop 18A being provided externally from the casing to facilitate the withdrawal of the pin when desired.

When the hole forming device is positioned between opposing wall forms 24, as will hereinafter be described, the pin 18 is withdrawn thus allowing the spring 16 to drive the telescopic element from the "set" position, to the expanded or released position at which time the distal ends 20 pierce the relatively thin end caps 23 and engage into the inner surfaces 25 of the wall forms 24 with the pointed or end sharpened ends readily engaging within these surfaces and anchoring the device securely in position.

However, it is necessary to move the body portions 22 outwardly against the end caps which have been displaced against the inner surfaces 25 and in this connection, there is provided anchoring means in the form of circular washers 26 upon each opposing face 27 of the body portions 22. These washers are apertured and of course the body portions are apertured to permit the passage of the jack 10.

Loops 28 formed of stiff wire or the like include out-turned ends 29 which engage against the washers 26 and then pass along the apertures within the body portions, and around the notched portions 20A of the distal ends 20 of the jack 10 so that when these members of the jack move outwardly when the pin is released, the rigid wire loops 28 draw the body portions 22 upwardly and into contact with the end caps 23 so that when concrete is poured between the wall forms 24, the end surfaces of the body portions are available for forming the hole through the concrete in the conventional manner.

Figure 6:
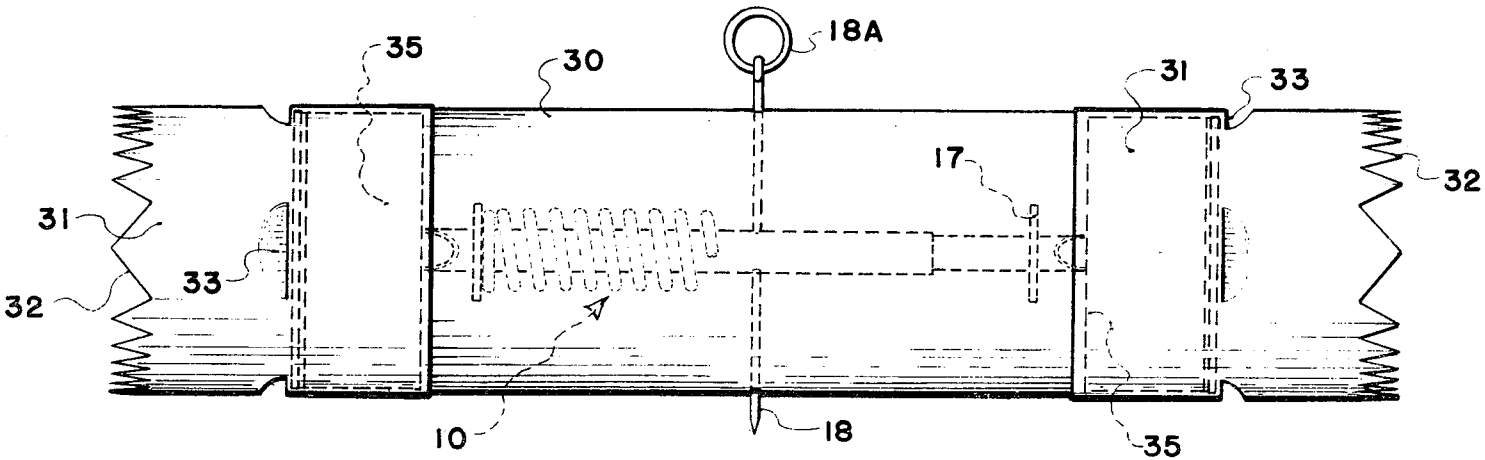
FIG. 6 is a side elevation of an alternative hole forming device with the jack being shown in phantom therein.

In the embodiment shown in FIGS. 6 and 7, once again a cylindrical casing is provided indicated by reference character 30 although other configurations can be used.

Figure 7:
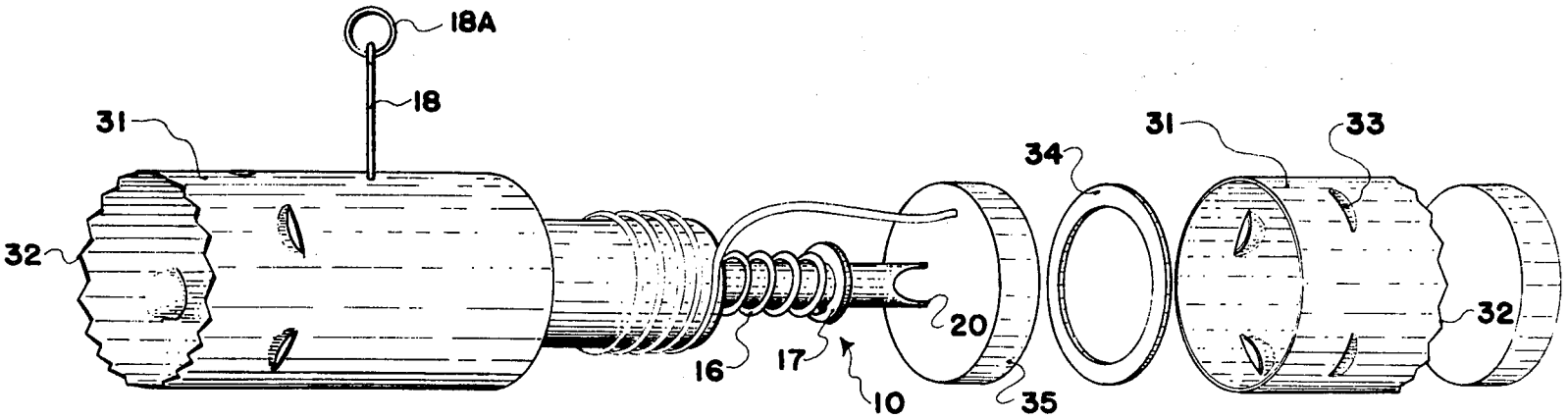
FIG. 7 is an exploded isometric view of FIG. 6 showing the device in the expanded or released position.

The construction of this particular type of hole forming device is shown in FIG. 7, but does not form part of the invention except for the provision of the movable cylindrical end portions 31 which slidably engage relative to the casing 30. It will be noticed that the distal ends of these cylindrical end portions are serrated or saw-edged as indicated by reference character 32.

Inwardly projecting portions 33 act as anchors for a metal or equivalent washer 34 situated within each end portion 31 against which a rigid foam block 35 engages and the jack 10 is situated axially through the casing with the ends 20 adjacent the cylindrical block 35.

When the pin 18 is released, the ends 20 are moved outwardly by the spring 16 and engage the block 35. These in turn move the cylindrical end portions 31, away from one another due to the washers 34 and engage the serrated edges of the distal ends with the inner surfaces 25 of the wall forms 25, once again holding the hole forming device in position.

Figure 9:
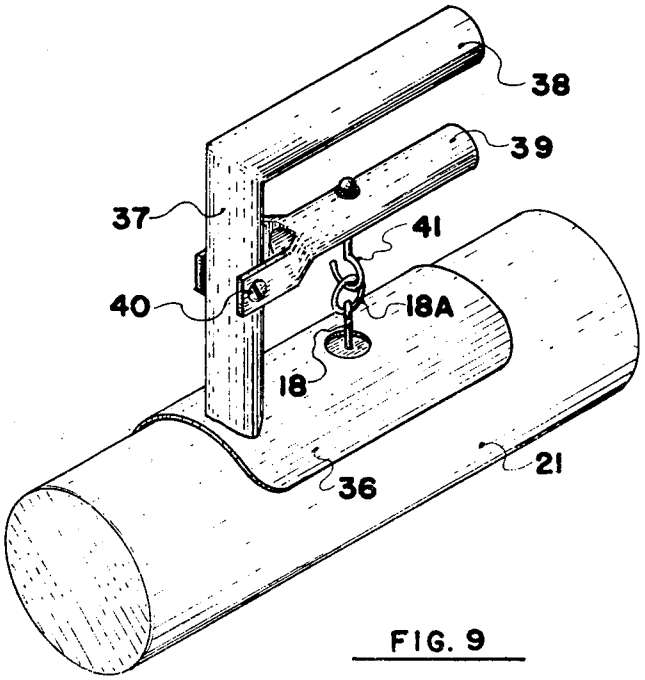
FIG. 9 is an isometric view of the setting tool shown in FIG. 8.
Figure 8:
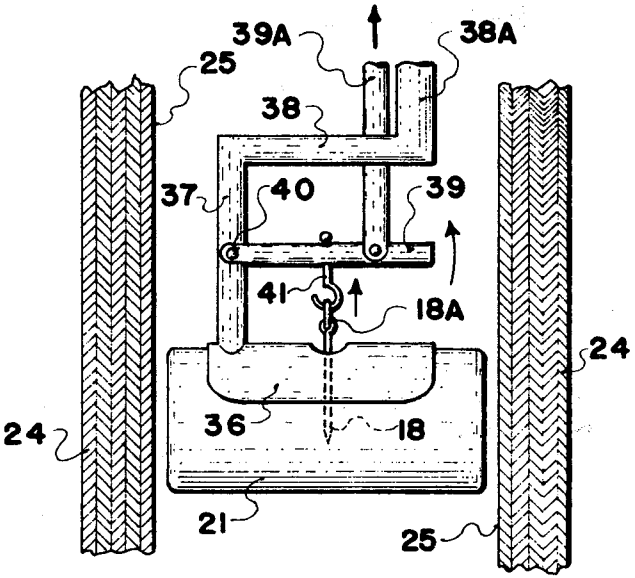
FIG. 8 is a schematic end view of a portion of a pair of forms showing the setting tool installing a hole forming device in position.

It is desirable that a setting tool be used although this is not absolutely necessary. Such a tool is shown in FIGS. 8 and 9 and includes a curved casing engaging shoe 36 with a vertical handle portion 37 extending upwardly from one end thereof and terminating in a horizontal handle portion 38. A lever 39 is pivoted to the vertical portion 37 by means of pivot pin 40 and a hook 41 extends downwardly from the lever 39 and is adapted to be engaged through the loop 18A of the pin 18 thus releasably securing the hole forming device to the shoe as shown in FIGS. 8 and 9.

The hole forming device is positioned manually whereupon lever 39 is moved upwardly thus withdrawing pin 18 and releasing the jack mechanism.

Alternatively, extensions 38A and 39A may be provided on the portions 38 and 39 so that the mechanism can be operated remotely.

If desired, the jacks 10 may be used above or adjacent previously positioned hole forming devices to act as shields and/or deflectors, while concrete is being poured.

Needless to say, the jacks within the hole forming devices are easily removed once the hole forming devices are activated to form the bores through the finished concrete.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A support and installation jack for hole forming devices installed between forms prior to pouring concrete therebetween; comprising in combination telescopic elements moveable from between a released, extended position and a compressed set position and vice versa, a compression spring surrounding said elements, means adjacent the distal end of each of said elements between which said spring reacts, said spring normally urging said telescopic elements towards the said released position, and means co-operating with said telescopic elements to releasably hold said elements in the compressed set position with said compression spring being compressed, the distal ends of said elements being end sharpened.

2. The jack according to claim 1 in which said telescopic elements include a pair of members, one telescopically engaging the other for sliding lengthwise movement, said means co-operating with said elements to releasedly hold said elements in the compressed set position comprising a release pin engaging through mating apertures in said members.

3. The jack according to claim 1 in which said means adjacent each distal end of said elements between which said spring reacts comprises a friction washer surrounding each said element adjacent each end thereof, the ends of said spring engaging said friction washer.

4. The jack according to claim 2 in which said means adjacent each distal end of said elements between which said spring reacts comprises a friction washer surrounding each said element adjacent each end thereof, the ends of said spring engaging said friction washer.

5. The jack according to claim 1 and in combination with a hole forming device, said jack being situated axially within said device, said hole forming device including a casing, a pair of end caps, one on each end of said casing and a pair of body portions slidable within said casing, means co-operating between said jack and said body portions for urging said body portions outwardly against said end caps when said means co-operating with said telescopic elements, is released, said means co-operating between said jack and said body portions comprising anchoring means on the inner opposed faces of said body portions, and loop means extending between said anchoring means and the distal ends of said elements whereby when said elements are released, the outward movement of the ends thereof moves said loop means and hence said body portions outwardly away from one another and against said end caps.

6. The jack according to claim 2 and in combination with a hole forming device, said jack being situated axially within said device, said hole forming device including a casing, a pair of end caps, one on each end of said casing and a pair of body portions slidable within said casing, means co-operating between said jack and said body portions for urging said body portions outwardly against said end caps when said means co-operating with said telescopic elements, is released, said means co-operating between said jack and said body portions comprising anchoring means on the inner opposed faces of said body portions, and loop means extending between said anchoring means and the distal ends of said elements whereby when said elements are released, the outward movement of the ends thereof moves said loop means and hence said body portions outwardly away from one another and against said end caps.

7. The jack according to claim 3 and in combination with a hole forming device, said jack being situated axially within said device, said hole forming device including a casing, a pair of end caps, one on each end of said casing and a pair of body portions slidable within said casing, means co-operating between said jack and said body portions for urging said body portions outwardly against said end caps when said means co-operating with said telescopic elements, is released, said means co-operating between said jack and said body portions comprising anchoring means on the inner opposed faces of said body portions, and loop means extending between said anchoring means and the distal ends of said elements whereby when said elements are released, the outward movement of the ends thereof moves said loop means and hence said body portions outwardly away from one another and against said end caps.

8. The jack according to claim 4 and in combination with a hole forming device, said jack being situated axially within said device, said hole forming device including a casing, a pair of end caps, one on each end of said casing and a pair of body portions slidable within said casing, means co-operating between said jack and said body portions for urging said body portions outwardly against said end caps when said means co-operating with said telescopic elements, is released, said means co-operating between said jack and said body portions comprising anchoring means on the inner opposed faces of said body portions, and loop means extending between said anchoring means and the distal ends of said elements whereby when said elements are released, the outward movement of the ends thereof moves said loop means and hence said body portions outwardly away from one another and against said end caps.

9. The invention according to claim 5 which includes a setting tool operatively associated with said hole forming device and said jack, said setting tool comprising a handle portion, a casing engaging shoe on one end of said handle portion, and means on said handle portion operatively engageable with said means co-operating with said telescopic elements to releasably hold said elements in the compressed set position, to release said last mentioned means and hence said elements.

10. The invention according to claim 6 which includes a setting tool operatively associated with said hole forming device and said jack, said setting tool comprising a handle portion, a casing engaging shoe on one end of said handle portion, and means on said handle portion operatively engageable with said means co-operating with said telescopic elements to releasably hold said elements in the compressed set position, to release said last mentioned means and hence said elements.

11. The invention according to claim 7 which includes a setting tool operatively associated with said hole forming device and said jack, said setting tool comprising a handle portion, a casing engaging shoe on one end of said handle portion, and means on said handle portion operatively engageable with said means co-operating with said telescopic elements to releasably hold said elements in the compressed set position, to release said last mentioned means and hence said elements.

12. The invention according to claim 8 which includes a setting tool operatively associated with said hole forming device and said jack, said setting tool comprising a handle portion, a casing engaging shoe on one end of said handle portion, and means on said handle portion operatively engageable with said means co-operating with said telescopic elements to releasably hold said elements in the compressed set position, to release said last mentioned means and hence said elements.

* * * * *